US007059061B2

(12) United States Patent
French

(10) Patent No.: US 7,059,061 B2
(45) Date of Patent: Jun. 13, 2006

(54) FRAMER'S LAYOUT AND CUTTING GUIDE

(75) Inventor: Don Gregory French, 451 E. Via Cortes, Green Valley, AZ (US) 85614

(73) Assignee: Don Gregory French, Green Valley, AZ (US)

( * ) Notice: Subject to any disclaimer, the term of this patent is extended or adjusted under 35 U.S.C. 154(b) by 220 days.

(21) Appl. No.: 10/683,842

(22) Filed: Oct. 10, 2003

(65) Prior Publication Data

US 2004/0074160 A1 Apr. 22, 2004

Related U.S. Application Data

(60) Provisional application No. 60/418,238, filed on Oct. 10, 2002.

(51) Int. Cl.
*G01B 3/02* (2006.01)

(52) U.S. Cl. ..... 33/494; 33/759; 33/194

(58) Field of Classification Search ..... 33/494, 33/758, 759, 1 G, 562, 563, 566, 194
See application file for complete search history.

(56) References Cited

U.S. PATENT DOCUMENTS 1,004,471 A * 9/1911 Rose ..... 33/194
2,187,087 A * 1/1940 Leary ..... 33/758
3,270,421 A * 9/1966 Jones ..... 33/759
4,301,596 A * 11/1981 Sedlock ..... 33/494
4,367,590 A * 1/1983 Winter et al. ..... 33/758
4,499,666 A * 2/1985 Smith ..... 33/562
4,575,943 A * 3/1986 Baum, Jr. ..... 33/759
4,845,858 A * 7/1989 Thomas ..... 33/759
5,012,590 A * 5/1991 Wagner et al. ..... 33/759
5,335,421 A * 8/1994 Jones, Jr. ..... 33/494
5,367,783 A * 11/1994 Nygren ..... 33/613
5,519,943 A * 5/1996 Snyder ..... 33/494
5,724,747 A * 3/1998 Poorman ..... 33/759
D402,216 S * 12/1998 Gilliam et al. ..... D10/71
6,360,448 B1 * 3/2002 Smyj ..... 33/562
6,470,582 B1 * 10/2002 Renko ..... 33/494
6,494,014 B1 * 12/2002 Lafrance ..... 52/745.05
6,523,275 B1 * 2/2003 Medford et al. ..... 33/759
6,684,522 B1 * 2/2004 Chilton ..... 33/759

* cited by examiner

*Primary Examiner*—Christopher W. Fulton
*Assistant Examiner*—Amy R. Cohen

(57) ABSTRACT

The Framer's Layout and Cutting Guide was designed to simplify the house framing process by creating easily recognizable icons, representing pre-measured for accuracy basic framing functions, for both layout and cutting, which, when superimposed on/integrated—with a standard tape measure, would clean up and speed up the framing process, making it easier for the professional carpenter, as well as for the do-it-yourself homeowner.

1 Claim, 4 Drawing Sheets

Stud Icons
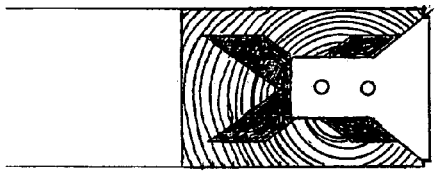
Figure 1-A: The Common Stud
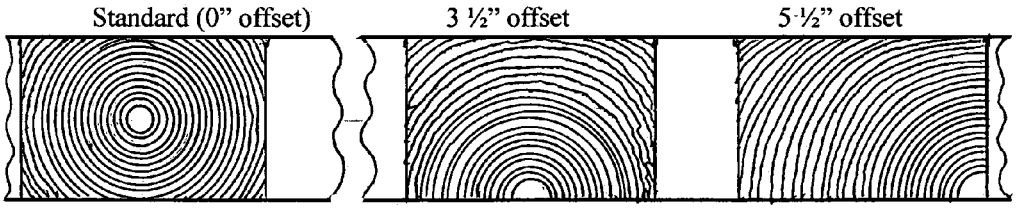
Figure 1-B: Stud Icons 16" On Center (O.C.)
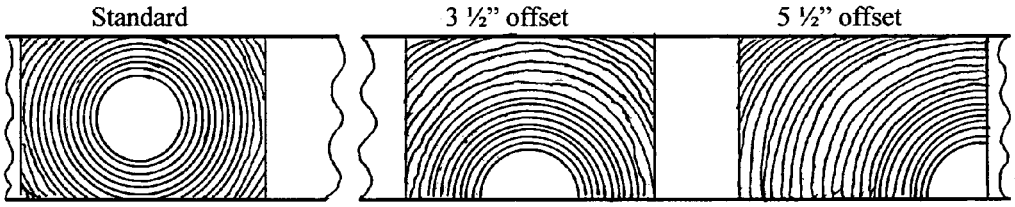
Figure 1-C: Stud Icons 24" O.C.
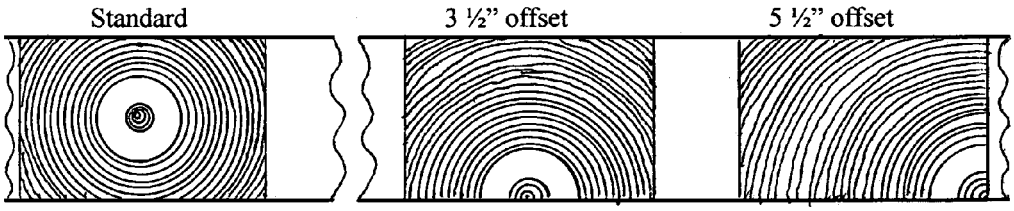
Figure 1-D: Stud Icons 16" & 24" O.C. Combined

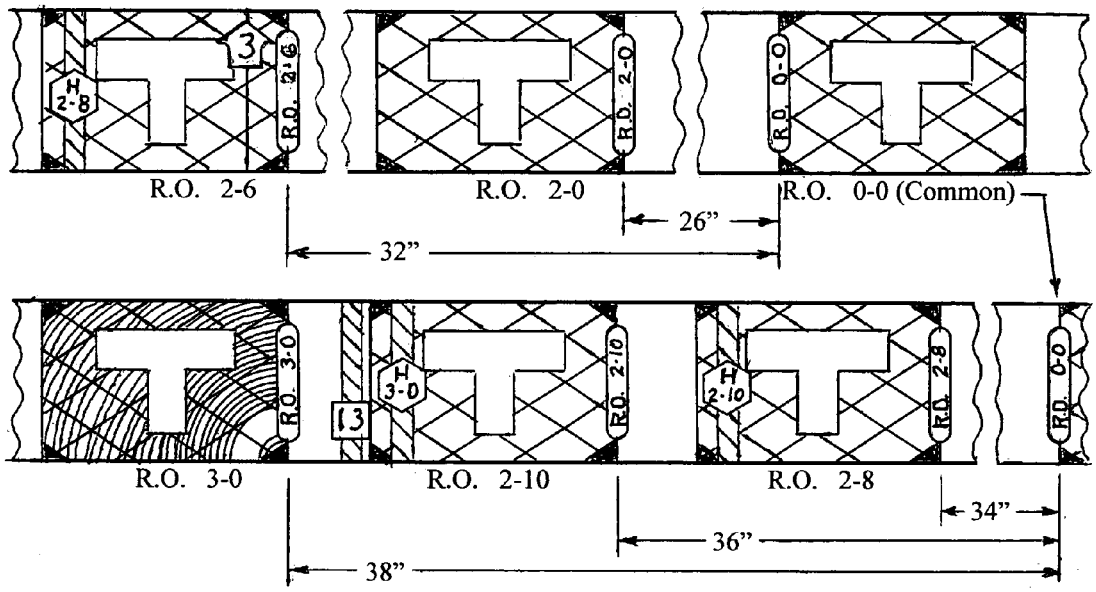
Figure 2-A: Residential Door Rough Opening (R.O.) Trimmers
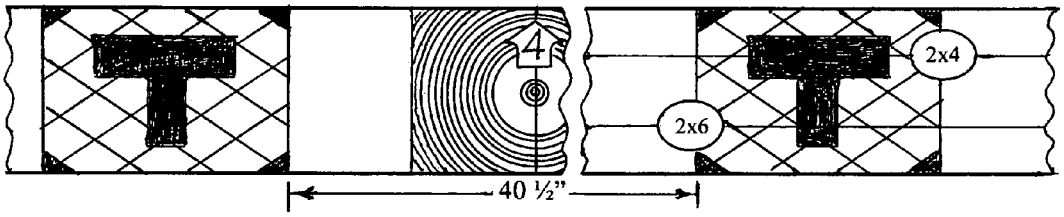
Figure 2-B: Commercial 3-0 Door Rough Opening Stud/Trimmers
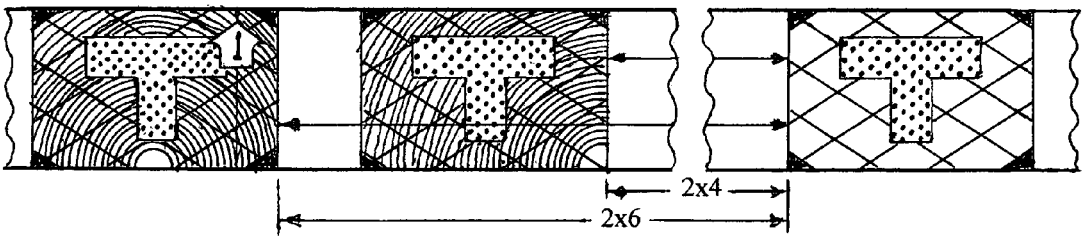
Figure 2-C: Wall Tee Layout System

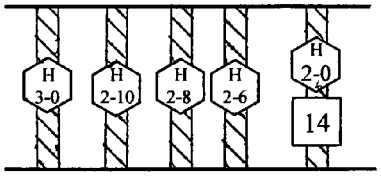
Figure 3-A: Header Cuts
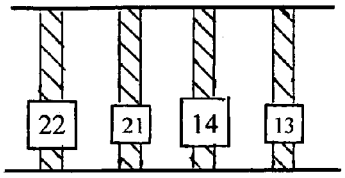
Figure 3-B: Block Cuts
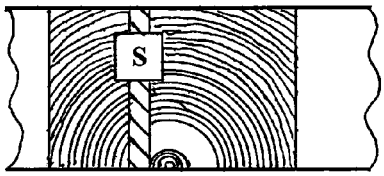
Figure 3-C: 92 5/8" Stud
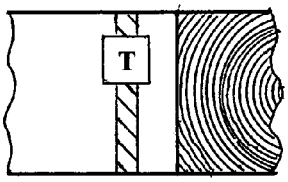
Figure 3-D: 81" Trimmer
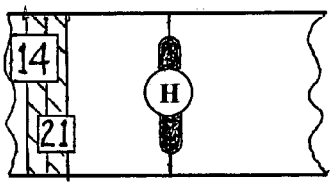
Figure 3-E: Header Mark
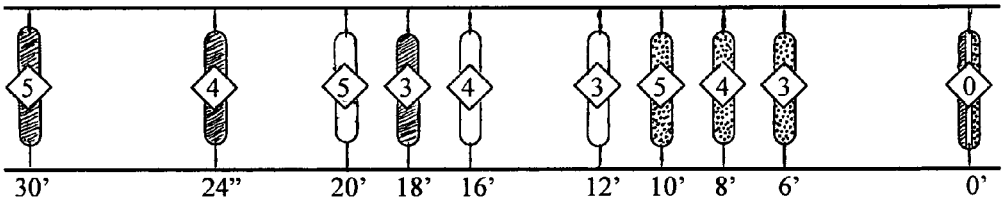
Figure 3-F: Squaring Sets 6'-8'-10'; 12'-16'-20'; 18'-24'-30'
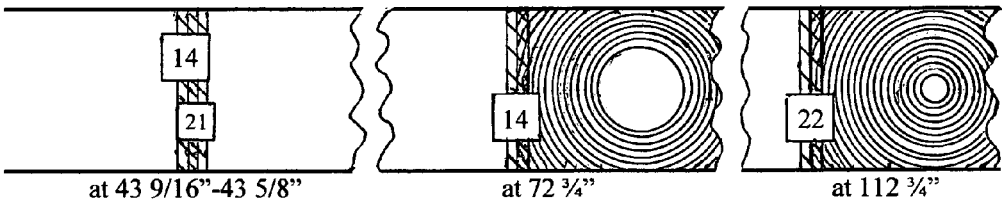
Figure 3-G: Overlaps

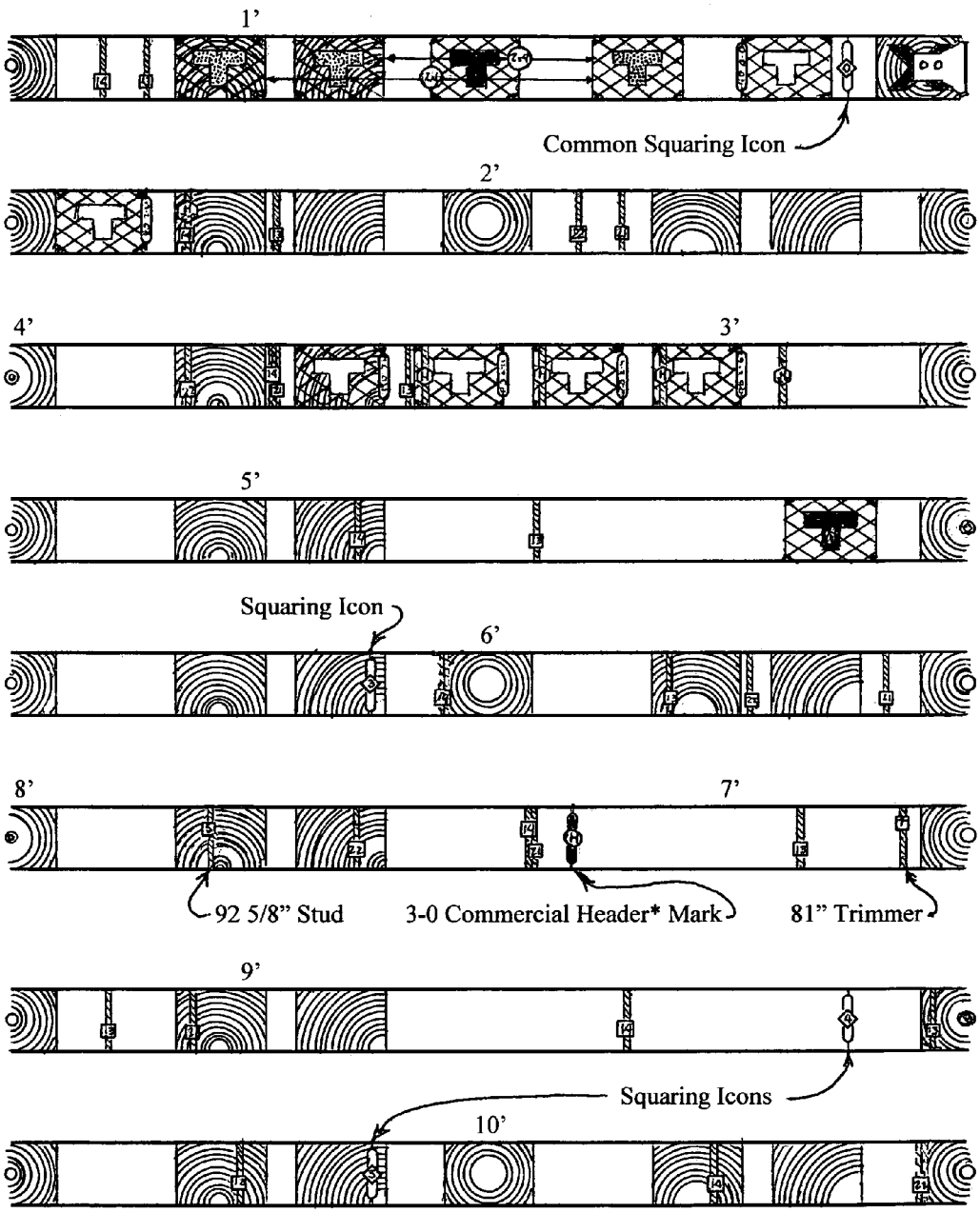
Figure 4-A
*for cross piece/no commercial headers

FRAMER'S LAYOUT AND CUTTING GUIDE

This application claims priority to Provisional Application 60/418,238 (Oct. 10, 2002)

BACKGROUND OF THE INVENTION

The Framer's Cutting and Layout Guide, or French Framer, is a carpenters tool to be used for home building and remodeling purposes.

Having been a carpenter for a long time gave me the idea of creating a tape measure for carpenters with various layout and cutting systems. The idea had come to me years earlier but it wasn't until the day I hung up my belt, in the storeroom of the house I built for my folks fifteen years before, that I really began working the problem. The stud layout, with its offset's were fixed, the key would be to see if a floating system of interior door rough openings would fit between the studs without interference. It wasn't possible but I found that by putting the common rough opening icon between 2¼" and 3¾" the one overlap was clean, that is the icon for the 3-0 rough opening was superimposed on a 5½" offset stud and the large "T" did not interfere with the offset's wood grain pattern in the corner. The wall tee system worked as well, this time with both of the wall tee icons being superimposed over a couple of stud icons, and again with a clean look. One of the two commercial 3-0 interior door rough opening trimmer/studs filled in the space between the common tee wing icon and the tee wing for the 2×4 wall tee, while the other end fit in nicely just past the four foot stud icon. In the first 51 inches the floating "T" systems distribute themselves compactly amongst the studs. The addition of various cutting icons presented minimal interference problems. When I did a patent search, on the nineteenth of June 2002, I only found one patent close to my work: Antoine Duvall Davis (U.S. D 466,462). When I was introduced to other framing guides through contact with the patent office I saw the superiority of the French Framer as it improves on Lafrance (U.S. Pat. No. 6,494,014) by using readily recognizable icons, for stud offsets, and door trimmers, and minimizing the use of numbers, for simplicity sake, and as to not interfere with the numbers on the standard tape measure with which it is superimposed upon/integrated with; is more professional than Chilton (U.S. Pat. No. 6,684,522) as blocks are normally cut a 16th of an inch shorter to allow for the natural cupping of joists, rafters and studs. Better than Smith (U.S. Pat. No. 4,499,666), as it is streamlined and compact when integrated with a standard tape measure. With the addition of the squaring system and the commercial applications the French Framer is the most complete and efficient framing tape.

BRIEF SUMMARY OF THE INVENTION

The Framer's Layout and Cutting Guide is a series of icons, representing common framing functions, superimposed on/integrated-with a standard tape measure for the purpose of speeding-up and cleaning-up the house framing process for Carpenters. The Framer's Layout and Cutting Guide works independent from the tape measure as all the measurements are built-in. In combining the Framer's Layout and Cutting Guide with the standard tape measure one has to remember their differences as many of the functions on the Framer's Layout and Cutting Guide are floating: not measured from the end of the tape but from each specific functions common icon.

| | Read: |
|---|---|
| Layout Functions: | |
| Squaring | floating (from 2" mark) |
| Sets of icons distinguishing 3-4-5 Right Triangles | |
| The Common Stud | end of tape |
| Alone or part of a corner | |
| Studs | end of tape (repetitive) |
| 16" O.C. (on center, plus 3½" & 5½" offsets (when tying into corners), | |
| 24" O.C., plus 3½" & 5½" offsets, | |
| 16" & 24" O.C. combined, plus 3½" & 5½" offsets | |
| Door Rough Openings/Trimmers | floating |
| Common Trimmer plus Standard Residential Rough Openings | |
| Wall Tee's (ties) | floating |
| Common Tee Wing plus 2 × 4 and 2 × 6 Wings | |
| Commercial 3-0 Door Rough Opening | floating |
| Commercial Header Mark | end of tape |
| Cutting: | |
| Stud (92⅝") | end of tape |
| Trimmer | end of tape |
| Headers | end of tape (repetitive) |
| Blocks | end of tape (repetitive) |
| Standard | |
| Starter | |

The earlier patent, the Framing Tape Measure Blade, only allows for "X's" on every 16" & 24" on center stud layouts. The Framer's Cutting and Layout Guide provides a system of wood grain patterns to distinguish, not only the differences between 16" and 24" on center stud layouts, and for when they overlap (every four feet: 4', 8', 12', 16', etc., as 2 times 24" and 3 times 16" equal 4'), but also those of the 2×4 and 2×6 offsets. And again, many other framing functions.

BREIF DESCRIPTION OF THE DRAWINGS

Framer's Layout and Cutting Guide is a tape marker as opposed to a tape measure. That is, all the framing functions on the Guide are pre-measured and have icons to determine their variations. The icons are readily identified by both form and color, although there is no color in these drawings. There are three types of icons: single line, with cartouche and legend/signs for layout; inch-and-a-half icons, designating the location of two-bys (also for layout), and; the ⅛" cutting icons.

FIG. 1-A

The Common Stud is located in the first one-and-a-half inches of the tape. It is recognized by a large black "X" in its center. Wood grain pattern is off-center.

FIG. 1-B

Stud icons representing 16" O.C. (on center) have concentric circles simulating wood grains, with small open circles in their centers. The standard read has the circle centrally located while the 3½" offset shows a half-circle, in the center of the bottom edge, and the 5½" offset shows a quarter-circle in a corner of the icon.

FIG. 1-C

Stud icons representing 24" O.C. have concentric circles with large open circles in their centers. The standard read has the circle centrally located while the 3½" offset shows a large half-circle, in the center of the bottom edge, and the 5½" offset shows a large quarter-circle in a corner of the icon.

FIG. 1-D

Stud icons representing 16" O.C. and 24" O.C. combined (every four feet) have concentric circles with large open circles in their centers, and within these large open circles are a group of small concentric circles whose largest circle is the same size as the corresponding 16" O.C. stud icon (i.e. the standard 16" O.C. stud icon small open circle is 5 mm in diameter; the standard 24" O.C. stud icon large open circle is 14 mm in diameter; and the standard 16" & 24" O.C. combined stud icon has a 5 mm circle, with smaller concentric circles within it, inside the 14 mm open circle).

All trimmer and wall tee icons have large "T's" in their centers set upon diagonal grid patterns with black "shoes" (triangles) in their corners.

FIG. 2-A

The residential door rough opening trimmers have large white "T's" in their centers and are floating. All layout marks are taken from the common trimmer near the beginning of the tape (R.O. 0-0). Rough opening measurements are taken from the forward edge of the common trimmer (where the cartouche/sign is: R.O. 0-0) to the corresponding trimmers lead edge, where its cartouche/sign is (i.e. for the 2-6 door rough opening it's 32"). The icon for the 3-0 residential door rough opening trimmer is superimposed over the first stud icon for 16" and 24" O.C. combined-5½" offset (the black "shoe" in the corner—showing the center of the wood grain—of this "T" icon may be left off in the future so that it doesn't interfere with recognizing the offset pattern). Some of the rough opening icons have header cut icons within their borders.

FIG. 2-B

The two commercial 3-0 door rough opening stud/trimmers are easily detected by the large black "T's" in their centers. The first icon is located near the beginning of the tape and is easily spotted, besides the black "T" in its center, because of the ellipses on its leading and forward edges with 2×4 and 2×6 designations within them. This is because the first commercial "T" icon is in the middle of the "Wall Tee Layout System" (the red "T's": see the first line of FIG. 4-A; the dot pattern represents the color red). The second commercial "T" is just outside the four foot mark, 40½" from the first "T".

FIG. 2-C

The wall tee layout system is readily found near the beginning of the tape due to the large red "T's" in their centers (dot pattern represents the color red). The common tee wing, nearest to the beginning of the tape, is connected to the other tee wings by lines with arrows having ellipse/signs in them to designate either the 2×4 or 2×6 wall tee being used. The 2×4 and 2×6 tee wings are superimposed over the first 16" O.C./5½" offset stud icon and the 16" O.C./3½" offset stud icon, respectively.

The cutting icons have double lines, an ⅛" apart (the width of a standard carbide tipped saw blade), connected by diagonals, and have angular perimeters on their legend/signs (i.e. square or hexagonal). The only layout icon to break this rule is the squaring function which has a diamond (being angular) within a cartouche.

FIG. 3-A

Header cuts are represented by hexagons, superimposed upon twin cut lines, with the letter "H" and the corresponding door opening size incorporated within it. These hexagons are usually centered between the lengths of the twin lines, except when the 2-0 header cut shares the same pair of cut lines as does the second 14⁷⁄₁₆" block.

FIG. 3-B

Block cuts have their respective designations (i.e. 13,14, 21,22) in squares, below the centers of the twin line cut icons. The standard block cuts (i.e. 14 & 22) have larger squares than the starter block cuts (i.e. 13 & 21) for easier recognition.

FIG. 3-C

The cutting icon for the 92⅝" stud has its square legend/sign towards the top of the twin cut lines, with a capital "S" in its center, and is found within a stud icon (16" & 24" O.C. combined/3½" offset).

FIG. 3-D

The 81" trimmer also has its square legend/sign towards the top of the cut lines, but has a capital "T" in it.

FIG. 3-E

The commercial header mark, at 86½", is comprised of a large "H" within a circle superimposed on a black cartouche. It comes just before the only pair of adjacent cut lines (multiples of 14⁷⁄₁₆" blocks and 13¹¹⁄₁₆" blocks)

FIG. 3-F

This figure shows a scaled-down version of the squaring functions on a 30'-2" tape so the various squaring sets can be seen. Each set has a different color for its cartouche while the common squaring icon (0) has three different colors on it.

FIG. 3-G

This figure shows the three overlaps where color and good graphics are needed to make the icons readily distinguishable.

FIG. 4-A

All of page 4—4 is considered as FIG. 4-A. Ten plus feet of the Framer's Layout and Cutting Guide are shown so as to give the examiner a better view of the Guide. Each strip is sixteen inches. In the first strip, with the beginning of the tape in the upper right hand corner, and reading right to left, the icons start in this order: the common stud (X); the common squaring icon (0); the common residential rough opening trimmer (white "I"); the common tee wing (red "T"/dot pattern); and the first commercial 3-0 stud/trimmer (black "T"). Then comes the two wall tee wings (2×4 & 2×6) superimposed over a couple of stud icons, followed by a couple of block cutting icons. Running down the left and right sides of the page we can see the 16" O.C. stud icons being split. At four and eight feet we can see where the 16" O.C. stud icons combine with the 24" O.C. stud icons (standard 0" offset). Running our eyes down the center of the page we can see where the 24" O.C. stud icons (i.e. 2', 6', 10') stick out. The squaring icons are pointed out so that the first squaring set can be seen (i.e. 6'-2", 8'-2", 10'-2"). The rest should be self explanatory.

DETAILED DESCRIPTION OF THE INVENTION

The Framer's Layout and Cutting Guide provides the carpenter with ready access to pre-measured-for-accuracy common framing functions, easily recognized by a system of icons. A brief description of the layout process for house framing is given so the examiner may better appreciate the value of the Framer's Layout and Cutting Guide.

Layout is the process of determining where various framing members will go in the production of walls. The first part of layout usually involves some squaring and the outlining of where walls are to be placed. After this, the main part of the layout is in the marking of plates, the horizontal members (high and low) which hold the vertical members in place. These vertical members can either be studs (full length), wall tees (for tying-in intersecting walls), trimmers to support window/door headers, cripples (short, on center two-bys, below windows or above headers), or corners.

Squaring:

In squaring we always "cut" two inches, or take our read from the two inch line, so as to insure accuracy in our read, by eliminating the end of the tape (which moves to accept inside and outside measurements). Quite often squaring is done with two people, and the person holding the main part of the tape must remember to add two inches to the measurement. No need for that with the pre-measured Framer's Guide.

When we go to square a wall we use a 3-4-5 right triangle as a guide, as it is known that a triangle with edge-lengths of 3X, 4X, and 5X will necessarily create one angle being 90°. When squaring these walls it will be necessary to use the longest leg lengths possible to ensure squaring accuracy.

The existing wall and the wall being built always represent the two shorter legs of the 3-4-5 right triangle, and at their junction is a right angle. Opposite the right angle is an imaginary line called the hypotenuse, the 5X leg. In a 100'-2" tape the longest 5X leg can only be 100' (from the 2" squaring icon to the 100'-2" squaring icon; 5X=100', X=20'), thereby making the 4X length 80', and the 3X length 60'.

Here is an example of a typical squaring situation and as to how the Framer's Layout and Cutting Guide helps to speed up, and clean up, the squaring process. You're building a rectangular house with outside dimensions of 35' and 70'. The exterior walls have already been built and stood. There is a wall tee built into one of the 70' walls at 20' from one of the corners where a new wall is to be built, giving some dimension to what will be the front room. Our new wall is to be 15'-6" long. I plan to snap a chalk line on the decking where the new wall is to be located. I first make a mark on the bottom plate of the existing wall directly below the wall tee (to the side where the right triangle is to be formed), and then have my helper cut two inches, hold the common squaring icon to my new mark on the bottom plate, while I run the tape (the Framer's Layout and Cutting Guide) along the bottom plate towards the corner. I've pre-determined that the second squaring set (colored yellow) on the Framer's Guide will best suit my purposes, as the 4X length of 16'-2" is just longer than the length of my new wall and here is where I'll snap my chalk line to. Moving towards the corner I keep my eyes open for a yellow squaring icon with the number 3 in the legend/sign, distinguishing the third leg of my 3-4-5 right triangle. Here I place a second mark on the bottom plate. While my helper is still holding to the first mark I swing the tape and move to the general location where I'm to snap my chalk line, for the new wall to be built, perpendicular to the existing outside wall, while sliding the tape in my hand, out to the yellow 4X squaring icon (16'-2"). Then, putting the Framer's Layout and Cutting Guide to the deck, I take my pencil, put it to the edge of the yellow icon and with a sweeping motion I mark the deck (floor), creating an arc. I then instruct my helper to move to the second mark on the bottom plate and cut two inches again. As he is doing this, the Framer's Layout and Cutting Guide is sliding through my fingers and extending. When it reaches the third yellow squaring icon, with the number 5 in the legend/sign, and my helper gets set on the second mark on the bottom plate, cutting two inches (where the common squaring icon is), I then find where the 5X squaring icon intersects my recently drawn arc and make another mark on the deck. A chalk line snapped through this point and the original mark on the bottom plate, below the wall tee, assures me that my new wall will be square to the existing wall, as one side of the bottom plate of my new wall will be nailed to the chalk line.

There are twenty "set" possibilities, in whole numbers, for a 100' tape (every five feet). In selecting which sets to use, in producing the tape, the determining factor was in eliminating overlaps (i.e. with 60'-80'-100' lengths and with 48'-64'-80' lengths, the second leg of the first set and the third leg of the second set are identical). One had to be eliminated. It was necessary to uses the same sets in all tape lengths (i.e. 30'-2", 55'-2", 100'-2") so that you could use the tapes in conjunction with each other, if desired (if you used the Framer's Layout and Cutting Guide along with a standard tape measure, you would still be able to speed up the squaring process by referring to the Framer's Guide for pre-measured lengths on the various squaring sets).

Squaring Functions for 30'-2", 55'-2", & 100'-2" Tapes

For the squaring function it was necessary to extend the tape two inches so that 30', 55', and 100' dimensions (legs) could be used, as we are "cutting" two inches, for a clean read at the beginning of the tape. Remember, all reads are from the squaring icon at the 2" mark at the beginning of the tape.

There are three sets of three squaring reads for 3-4-5 right triangles on a 30'-2" tape: five sets of three squaring reads on the 55'-2" tape: and eight sets of three squaring reads on the 100'-2" tape (each longer tape includes the shorter tapes sets).

| 3X leg | 4X leg | 5X leg | Set Color |
|---|---|---|---|
| 30'-2" | | | |
| 6'-2" | 8'-2" | 10'-2" | red |
| 12'-2" | 16'-2" | 20'-2" | white |
| 18'-2" | 24'-2" | 30'-2" | blue |
| 55'-2" | | | |
| 27'-2" | 36'-2" | 45'-2" | yellow |
| 33'-2" | 44'-2" | 55'-2" | red |
| 100'-2" | | | |
| 42'-2" | 56'-2" | 70'-2" | white |
| 51'-2" | 68'-2" | 85'-2" | blue |
| 60'-2" | 80'-2" | 100'-2" | yellow |

FIG. 0-A

Plate Layout:

After we've done our squaring; marked and snapped lines on the decking (wood or concrete surface), where our new walls are to go, we are ready to build walls. We usually use 12 & 16 foot lengths for our plates, finding the straightest pieces for our purpose. Two 16 footers will work well for each of our short walls. There will be two 15'-6" walls, one on each side of the kitchen. We'll focus on the back wall because it has a standard 2-6 door in it, for accessing a pantry.

Having just nailed (or screwed) the plates together, so they don't move during the layout process, I pull out my Framer's Layout and Cutting Guide and I hook it to the end of the plates and begin to pull (extend the tape). The plans inform us our studs are to be 16" on center. Because we are tying into the middle of a pre-existing wall we know that we will have no offset and our common stud, at the beginning of the Framing Guide will stand alone. We then make a mark at the forward edge of the icon for the common stud and proceed to make marks on both edges of each icon for 16" on center studs, following this up with a framing square, because it has a blade 1½" thick, and put lines where every mark is. Now there is an 1½" space between several sets of twin lines. Before we can designate each space, as either an "X" for stud or "C" for cripple, we need to see what other elements go into the wall. Besides the door, near the beginning of our layout, there will be a 2×4 wall tee 30" from the other end of the plates, to tie in a bathroom wall. The plans call for a 12" shelf on the right as we walk into the pantry and the door opening in front of them, so we can use the first 16" on center stud markings for our king stud (the stud on the hinge side of your doorway), leaving ample room for the door to open unimpeded. Pencil in hand, I take out the Framer's Layout and Cutting Guide, and holding the end of the tape, slide my thumb to the lead edge of the common trimmer icon and place it next to my king stud. First I make a mark on the forward edge of my common trimmer, then I extend the tape to the "R.O. 2-6" trimmer, marking each side of it. After putting the tape measure away, I put two large "T's" between the new marks (one next to the king stud), draw lines with my framing square, adding a new line next to the far trimmer as a stud will have to support it, and put "C's" in the 16" on center marks between the two trimmers. Then I go to the other end of the plates and layout my 2×4 tee, 30" from the end. Having no interference from would be studs (16" on center stud layout), I open my Framer's Guide to the wall tee icons and place the forward edge of my common wall tee to the 30" mark (making sure the 2×4 tee is on the correct side of my mark) and proceed to mark off my tee wings. After drawing lines on my wing marks, I write the word "tee" in between them and can now finish my layout by putting "X's" in between any remaining open lines, designating all these as full studs.

Having the rough opening pre-measured saved me some time as I didn't have to do any calculating: door size-plus 2" for rough opening. With the trimmer icons in place there was no need to visualize them, especially if they ran into existing stud placements. The same goes for the wall tees; no need to visualize or add up inches on layout. The Framer's Layout and Cutting Guide will also save time when we go to cut our door trimmers (pre-measured trimmer icon), and the header—actually a "flat" 2×4 as the wall is non-load bearing—with the pre-measured header cut.

Stud Layout: Read from End of Tape

A series of 1½" icons are used to represent locations for both 16" and 24" on center (O.C.) studs, including 3½" and 5½" offsets. Offsets are needed when making outside corners. The studs in one wall have to be offset either 3½" or 5½" depending on your wall thickness (2×4 or 2×6) so that your plywood sheathing, code for corners, will fit properly.

The offsets for the 16" O.C., the 24" O.C., and the 16" & 24" O.C. combination stud icons are distinguished by the following simulated wood grains: a wood grain starting in the center=0" offset (a standard read); a wood grain starting in the bottom center=a 3½" offset; a wood grain starting in the corner=a 5½" offset.

The on center layouts: 16" O.C.; 24" O.C.; and the 16" & 24" O.C. combined; are distinguished by their stud icons center. 16" O.C. stud icons have small open circles surrounded by concentric circles. The 24" O.C. stud icons have large open circles surrounded by concentric circles, and the 16" & 24" O.C. combined stud icons are a combination of the two except that when combined the smaller circle, now within the large open circle, has concentric circles within it (see drawing 1–4).

Every four feet each stud icon repeats itself (except for the common stud at the beginning of the tape). I'm experimenting with colors for easier recognition. Although the color combinations may change later on, it is important to know that the wood grains patterns will not, other than some refinement (i.e. realistic looking wood grains).

Wall Tee Layout System: Between 4¾" and 13¼"

When you have intersecting walls, a stud length two-by is turned sideways, in the middle of one wall, to provide a nailing surface to attach the end of the other wall. This two-by is then itself supported by two other perpendicular two-by's, referred to as wings, on each of its sides. These wings, which are the width of the plates, strengthen the first two-by and provide good nailing surfaces to tie into the plates. The combination of the sideways two-by and its two wings are called a (wall) "Tee". The width of the sideways two-by will be the width (2×4 or 2×6) of the intersecting wall, and the width of the two-by wings will be the width of the first wall (2×4 or 2×6).

The Common Wall Tee Wing, between 4¾" & 6¼", and the 2×4 and 2×6 Tee Wings all have large red "T's" in their centers. The 2×4 Tee wing is located between 9¾" & 11¼", 3½" (the width of a 2×4) from the Common Tee Wing. The 2×6 Tee Wing is located between 11¾" & 13¼", 5½" (the width of a 2×6) from the Common Tee Wing. Both the 2×4 and 2×6 Tee Wings are superimposed on the first two stud icons for 3½" and 5½" offsets, making them easily recognizable over time.

The Wall Tee Layout System is a floating read: just lay the open tape on your plate and mark in the appropriate tee (2×4 or 2×6). This tee layout system gives us another advantage: whenever you want a quick read on either a 2×4 or 2×6 width (3½", or 5½"), you have the measurement built in. Just follow the arrows/lines between the Common Tee Wing and the respective 2×4 or 2×6 Tee Wings. Each of these arrow lines has an elliptical legend/sign designating the respective two-by and/or tee size. (see FIG. 2-C on drawing 2-4)

The Trimmer Layout System: Between 2¼" and 43¼"

An inch-and-a-half icon, with a large white "T" in its center, is a common trimmer for each of the standard residential door rough openings. In determining rough opening sizes we add two inches to the door size. These two inches include jambs (2×¾"), and a half-inch for shimming. Two trimmers, to support a header, are placed on each side of this opening. On the Framer's Layout and Cutting Guide these functions are pre-measured for speed and accuracy, and again make it easy to visualize how the door opening fits into the scheme of the wall. The Common Trimmer has a cartouche on its forward edge with "0"-"0" inside it and is located between 2¼" and 3¾". All the other trimmer icons have their respective rough opening sizes in a cartouche on their lead edges (i.e. R.O. 2-6), and also have a large white "T" in their center.

Residential Door Rough Openings (R.O.'s) Floating Read
2'-0" (26") between 29¾" & 31¼"
2'-6" (32") between 35¾" & 37¼"
2'-8" (34") between 37¾" & 39¼"
2'-10" (36") between 39¾" & 41¼"
3'-0" (38") between 41¾" & 43¼"—superimposed upon the first 5½" offset/combination 16" & 24" on center stud icon.

FIG. 0-C (see FIG. 2-A on drawing 2-4 for trimmer icons)

Cutting Icons: Read from the End of Tape

Once the plates have been laid out we are ready to cut the other wall components. All cut lines, on the Framer's Guide, are ⅛" thick, the width of a standard carbide-tipped blade, so that they may be marked on either side depending on your cutting preference, and are to be read from the end of the tape. The cutting icon consists of twin lines, an ⅛" apart, connected by diagonal lines. Cutting icons will have angular readings, such as hexagonal or square legend/signs. (see FIGS. 3-A, 3-B, 3-C & 3-D on drawing 3-4).

Standard 92⅝" Stud Read from the End of the Tape

The Framer's Guide has a cutting mark for standard stud lengths if you need to cut your own. We use the 92⅝" length so that when the thickness of the plates (including a double top plate) is added (4½") we have a total wall height of 97⅛", making allowances for our drywall installation: ½" for the lid (top piece), and two 4'×8' sheets (always hung horizontally for structural reinforcement); 4'+4'+½"=96½". 97⅛"−96½"=⅝". The ⅝" difference allows for easy drywall installation and is covered later by baseboard.

The Standard 81" Interior Door Trimmer Read from the End of Tape

Regardless of the wall height our trimmers will be standard. This is a function that is used over and over again in home building. Having a cutting line pre-measured for accuracy will speed up the process.

Header Cuts: Read from the End of Tape

Headers are strong horizontal components that are placed above openings, such as doors and windows, to support any framing, including roofing, above them. A typical header is comprised of two two-bys, quite often 2×12's, standing on their sides parallel to each other, and nailed together with either a ½" plywood spacer or a 2½" block spacer between them; depending on the width of the wall being built. Interior doors that do not require a header can use the Header Cut measurement for their "flats": short, non-load bearing, cross pieces that sit on your trimmers.

The Framer's Layout and Cutting Guide has the standard interior door header lengths pre-measured for accuracy and speed, represented by hexagonal legend/signs on twin cut lines (⅛" thick). To obtain the lengths for standard pre-hung door headers we take the width of the door, say 24" for a 2-0 door, and add three inches for the two supporting trimmers, plus two inches for the rough opening (two ¾" jambs and ½" shimming space for plumbing adjustments); 24'+3"+2"=29".

Standard Door Header Cutting Icons Read from the End of the Tape

29"–29⅛" (for 2-0 door) same cut as second 14½" block

35"–35⅛" (for 2-6 door)

37"–37⅛" (for 2-8 door)

39"–39⅛" (for 2-10 door)

41"–41⅛" (for 3-0 door)

FIG. 0-D

Blocking Icons: Read from the End of Tape

The Framer's Layout and Cutting Guide is designed so you can make marks for multiple block cuts easily. A typical block, between studs, rafters, or joists, is cut 1/16" shorter than its nominal length to allow for cupping in said studs, rafters, and joists. A standard 22½" block is cut at 22 7/16", and a 14½" block is cut at 14 7/16". When we are adding sixteenths, plus an eighth inch for our cuts, multiple cuts get a little confusing. If you have ever had to cut blocks you would understand how the Framer's Guide would really speed up the process.

The Framer's Guide has cutting icons for both standard and starter blocking. The numbers in the icons have been abbreviated to save space: 22=22 7/16", 21=21 11/16", 14=14 7/16", 13=13 11/16" (coloring and icon subject to change).

Standard Blocking (see FIG. 3-B on drawing 3-4)

| 14½" blocks (14 7/16") | 22½" blocks (22 7/16") |
|---|---|
| 14 7/16"–14 9/16" | 22 7/16"–22 9/16" |
| 29"–29⅛" | |
| 43 9/16"–43 11/16" | 45"–45⅛" |
| 58⅛"–58¼" | 67 9/16"–67 11/16" |
| 72 11/16"–72 13/16" | |
| 87¼"–87⅜" | 90⅛"–90¼" |
| 101 13/16"–101 15/16" | 112 11/16"–112 13/16" |
| 116⅜"–116½" | |
| 130 15/16"–131 1/16" | 135¼"–135⅜" |
| 145½"–145⅝" | 157 13/16"–157 15/16" |
| 160 1/16"–160 3/16" | |
| 174⅝"–174¾" | 180⅜"–180½" |
| 189 3/16–189 5/16 | |
| FIG. 0-E | |

Starter Blocking (see FIG. 3-B on drawing 3-4)

| 13¾" Blocking (13 11/16") | 21¾" Blocking (21 11/16") |
|---|---|
| 13 11/16"–13 13/16" | 21 11/16"–21 13/16" |
| 27½"–27⅝" | |
| 41 5/16"–41 7/16" | 43½"–43⅝" |
| 55⅛"–55¼" | 65 5/16"–65 7/16" |
| 68 15/16"–69 1/16" | |
| 82¾"–82⅞" | 87⅛"–87¼" |
| 96 9/16"–96 11/16" | 108 15/16"–109 1/16" |
| 110⅜"–110½" | |
| 124 3/16"–124 5/16" | 130¾"–130⅞" |
| 138"–138⅛" | |
| 151 13/16"–151 15/16" | 152 9/16"–152 11/16" |
| 163⅝"–163¾" | 174⅜"–174½" |
| 177 7/16"–177 9/16" | |
| FIG. 0-F | |

COMMERCIAL APPLICATIONS

Besides the squaring functions and the stud locations there are two other functions expressed on the Framer's Layout and Cutting Guide that can be used in commercial metal stud construction: the 3-0 Door Rough Opening; and the 3-0 door "Header Mark".

3-0 Interior Door Rough Opening Floating

Although there are no trimmers in commercial interior walls, for there are no headers (no load bearing interior walls), the Framer's Layout and Cutting Guide has large black "T's" in the icons representing the doorway studs. They are placed 40½" apart; the door size plus 4½'. The rough opening is between 9" and 49½". The icons are located at 7½"–9", and 49½"–51". The red, white, and black "T" icons correspond to golf tee markers as red is the short tee, white is the regular tee, and black represents the longest tee for professionals or in this case the commercial application.

Header Mark Read from the End of Tape

This icon marks the location of the crosspiece or "flat" above the 3-0 commercial interior door. The end of the tape is placed at the bottom of the bottom plate and is pulled to 86½", where the header mark is found. A mark (>) would be made at the header mark and an "X" placed to its forward edge on each of the doorway stud/trimmers, indicating where the crosspiece is to go.

Overlaps:

There are a few places on the Framer's Layout and Cutting Guide where icons overlap. With a little practice these idiosyncrasies will not be a problem. Here is a list of overlaps: the 2×4 & 2×6 wall tee wings share the same space with first 5½" & 3½" offsets for 16" O.C. studs, respectively; the 2-0 header cut shares the same space with the second 14⁷⁄₁₆" block, between 29" and 29⅛"; and the trimmer for the 3-0 residential door rough opening shares the same space as the first 5½" offset stud icon for 16" & 24" O.C. combined, between 41¾" & 43¼".

The only three overlaps that weren't "clean" were: where the second 21¹¹⁄₁₆" block and the third 14⁷⁄₁₆" block share a sixteenth inch space (43¹⁰⁄₁₆" to 43¹¹⁄₁₆"); where a 14⁷⁄₁₆" block is split over the forward edge of a stud icon at 72¾"; and where a 22⁷⁄₁₆" block is split over the forward edge of a stud icon, at 112¾". With some color added and some "clean" graphics, and a little practice, these overlaps will be easily recognized.

Quite often block cuts will lie within stud icons but won't interfere with their marking edges. Also, just past the commercial header mark, two block cuts are right next to each other and one of the legend/signs has to be raised higher than its normal position. All overlaps are illustrated in the drawings.

I claim:

1. An improved system of icons for the layout and cutting of frame carpentry on a tape having a surface, comprising;

a) wood grain patterns, emulating tree rings with concentric circles, expanding outward from a central point, on 1½" icons, are used to differentiate stud layouts, with said wood grain patterns being of three types: for 16" on center studs, said wood grain pattern will have a small inner circle surrounded by said concentric circles expanding outward; for 24" on center studs, said wood grain patterns will have a large inner circle, surrounded by said concentric circles expanding outward; and for 16" and 24" on center combined, said wood grain pattern will have a small wood grain inner circle within a large circle surrounded by said concentric circles expanding outward; said wood grain patterns are centered on said tape for zero offset, the center of said wood grain pattern is on an edge of said tape, within said icons, for the 3½" offset, and the center of said wood grain pattern is in the corner of said icons, on said tape for the 5½" offset;

b) a floating system of 1½" icons, on said tape, with large colored "T"'s in their centers and having a criss-cross of diagonal lines in the background on said tape icon, with irregular triangles/arrows or shoes for corners to determine trimmer and wall tee layout; are used on said tape to differentiate: the 40½" commercial interior door rough opening with two black "T" icons, the first of said black "T" icons being located between 7½" and 9" from the beginning of said tape; while the second said black "T" icon is located between 49½" and 51" from the beginning of said tape; from the residential rough openings for interior doors distinguished by white "T"'s, having a common "T" icon, on said tape between 2¼" and 3¾", while the line at 3¾", being 90 degrees perpendicular to the edge of said tape having a cartouche superimposed upon it with the letters "RO" representing "Rough Opening", and the numbers 0-0, representing the common trimmer, serving five common residential door rough opening white "T" icons; 26" for 2-0, 32" for 2-6, 34" for 2-8, 36" for 2-10, and 38" for 3-0, on said tape, each having a cartouche superimposed on the inside line (closest edge of the icon to the beginning of said tape) of said white "T" icons distinguishing door sizes (i.e. RO 2-0, RO 2-6, etc.); and from the residential 3½" & 5½" wall tees distinquished by red "T"'s in their centers and having a common icon, on said tape, between 4¾" and 6¼", and having the 3½" wall tee "T" icon superimposed over a 16" on center/5/1;2" stud offset icon, on said tape, and the 5½" wall tee "T" icon superimposed over a 16" on center/3½" offset stud icon, on said tape;

c) for blocking, a plurality of spaced stations longitudinally disposed on said surface of said tape, said first plurality of spaced stations being 14⁷⁄₁₆" apart and separated by ⅛" cutting icons, and a second plurality of spaced stations longitudinally disposed on said surface of said tape, said second plurality of spaced stations being 22⁷⁄₁₆" apart and separated by ⅛" cutting icons, and a third plurality of spaced stations being longitudinally disposed on said surface of said tape, said third plurality of spaced stations being 13¹¹⁄₁₆" apart and separated by ⅛" cutting icons, and a fourth plurality of spaced stations longitudinally disposed on said surface of said tape, said fourth plurality of spaced stations being 21¹¹⁄₁₆" apart and separated by ⅛" cutting icons;

d) said ⅛" cutting icons having diagonals going from long edge to long edge, of said icon, on said tape, to give the appearance of a saw blade, a layout mark, composed of a cartouche superimposed on a line, on said tape, with a large circle superimposed on said cartouche, having a large "H" in its center, representing the commercial crosspiece/header for a standard 3-0 interior commercial door at 86½";

a system of icons, on said tape, composed of cartouches superimposed on lines 90 degrees from edge of said tape, designating various squaring sets, working from a common icon, on the 2 inch line, of said tape, said cartouches being split in their centers by diamonds, actually squares standing on a vertex, having their sides at 45 degree angles to the edges of said tape, whereas the diamond on the common squaring icon has a large "0" in it, and each subsequent diamond cartouche, on said tape, has either a 3, 4, or 5 in it to designate which leg of the 3-4-5 right triangle is being represented, and different colors will be used to distinguish between said sets, on said tape.

* * * * *